United States Patent [19]

Vaux

[11] Patent Number: 4,827,577

[45] Date of Patent: May 9, 1989

[54] ANTI-THEFT DEVICE FOR ARTICLES WITH AT LEAST ONE ANCHORING STRUCTURE

[75] Inventor: Jean-Pierre Vaux, Le Raincy, France

[73] Assignee: Etablissements ED. Vaux, Montfermeil, France

[21] Appl. No.: 54,857

[22] Filed: May 27, 1987

[30] Foreign Application Priority Data

Feb. 20, 1987 [FR] France ..... 87 02273

[51] Int. Cl.[4] ..... A44B 9/00

[52] U.S. Cl. ..... 24/704.2; 24/303

[58] Field of Search ..... 24/303, 150 R, 94, 688, 24/704; 292/251.5

[56] References Cited

U.S. PATENT DOCUMENTS

| | | | |
|---|---|---|---|
| 2,648,884 | 8/1953 | Loofboro | 24/303 |
| 3,112,638 | 12/1963 | Bey | 24/303 |
| 3,127,653 | 4/1964 | Budreck | 24/303 |
| 4,299,870 | 11/1981 | Humble | 24/150 R |
| 4,670,950 | 6/1987 | Wisecup et al. | 24/150 R |

*Primary Examiner*—Victor N. Sakran

*Attorney, Agent, or Firm*—Berman, Aisenberg & Platt

[57] ABSTRACT

An anti-theft device for articles or items with at least one anchoring structure. This device comprises an anti-theft magnetic tag comprising the means for connection to the said anchoring structure. These connection means comprises, on the one hand, clamping means intended to cooperate with the locking device of the magnetic tag and clamp to the latter, and, on the other hand, means for latching the clamping means-magnetic tab assembly onto the anchoring structure of the object or item to be protected against theft.

12 Claims, 4 Drawing Sheets

ANTI-THEFT DEVICE FOR ARTICLES WITH AT LEAST ONE ANCHORING STRUCTURE

FIELD OF THE INVENTION

The present invention relates to theft prevention, notably prevention of larceny perpetrated in stores, for example in large supermarkets. The invention relates more specifically to an anti-theft device for articles with at least one anchoring structure.

BACKGROUND OF THE INVENTION

Until now, theft prevention, particularly in large supermarkets, has involved the use of anti-theft devices comprising magnetic tags fixed by a locking button on the article to be protected by a locking button. These devices of the prior art can only be used when the article can be penetrated by the locking device of the tag, which advantageously comprises a locking button with a central clamping point. In practical terms, this reduces the use of these devices to textiles and other off-the-peg clothes. Until now, nothing has been developed for the prevention of theft of other articles.

SUMMARY OF THE INVENTION

The aim of the invention is to remedy this state of affairs by providing an anti-theft device suitable for any article or item provided that it has at least one anchoring structure.

Another aim of the invention is to provide an anti-theft device of the said type which is suitable for the type of magnetic tag usually employed for avoiding theft.

A further aim of the invention is to provide an anti-theft device for articles or items with an anchoring structure, a device of simple design which is easy to fit onto the magnetic tags of the prior art.

The present invention relates to an anti-theft device for articles or items with at least one anchoring structure, this device comprising an anti-theft magnetic tag and being characterized in that it comprises means for fitting the magnetic tag to the anchoring structure, these fitting means comprising, on the one hand, clamping means which cooperate with the locking device of the magnetic tag and clamp to the magnetic tag, and, on the other hand, means for latching the clamping means-magnetic tag assembly onto the anchoring structure of the article or item to be protected.

The anti-theft device according to the invention is, moreover, distinguished by the following points:

the clamping means comprise a sliding member the shape of which closely fits that of the magnetic tag, this sliding member being fitted on its upper face, at one of its ends, with a first flexible clip cooperating at its free end with the locking device of the tag, and, at the other end, a second flexible clip with abutment means at its free end, this second clip presenting in the longitudinal direction an oblong port able to superimpose on a port of corresponding shape provided in the underlying support member which is joined or otherwise to the body of the magnetic tag;

the support member is a plate in the form of a U-bar the flanges of which are supported on the tag and fit into a housing of corresponding shape provided in the tag;

the support member presents an upper boss centered axially with the oblong port and intended, once the device is assembled, to fit into the port of corresponding shape provided in the upper face of the sliding member;

the latching means comprise a clip with an opening of the free edges from which extend two opposed anchoring clips, advantageously aligned and intended to be introduced into the two oblong ports of the sliding member and of the support member, these clips having, for example, the shape of a collar or of a split ring.

According to one variant of the embodiment of the anti-theft device of the invention, the clamping means comprise a flexible tongue fitted at one end with a flexible clip cooperating with the locking device of the tag and at the other end a second flexible clip, the tongue presenting moreover between its two ends an internal boss abutting the underlying support member. The second clip abuts the locking means and is intended to force the said locking means to assume a locking position against the action of the elastic means housed in a part supporting the latching means.

This variant of the embodiment of the anti-theft device according to the invention is, moreover, distinguished by the following points:

the support member is a tag comprising a central housing for the insertion of the flexible tongue;

the clamping means comprise a piston with an upper edge or sharpened structure delimited by a peripheral notch;

the elastic means comprise a spring housed inside the piston.

the latching means comprise an adjustable collar in the form of clip one end of which is fixed to the support member and passes through the said member to form a loop;

the adjustable collar comprises an outer threaded structure cooperating with the sharp edge of the piston, which is pushed between two neighboring turns of the thread when the device is locked.

BRIEF DESCRIPTION OF THE DRAWINGS

Further advantages and characteristics of the invention will become apparent upon reading the following description of a non-limiting form of the anti-theft device with reference to the appended diagrams in which.

DETAILED DESCRIPTION OF THE PREFERRED EMBODIMENTS

Figure 1:
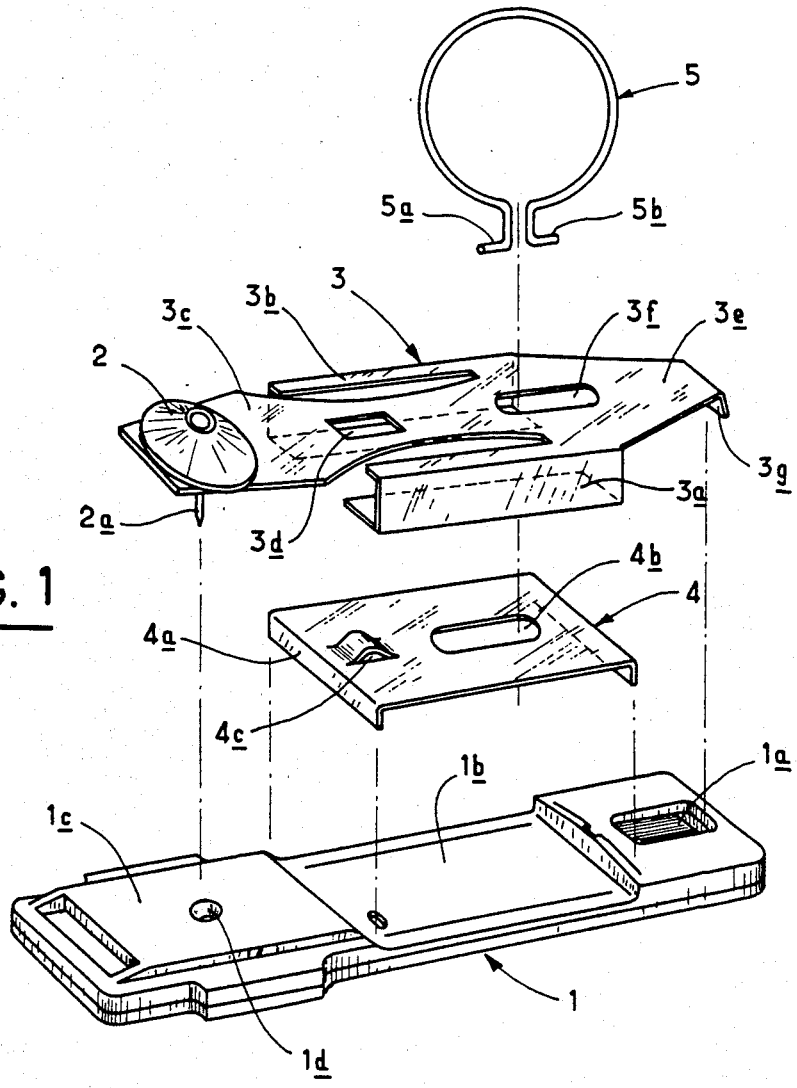
FIG. 1 is an exploded perspective view of the various components of the anti-theft device of the invention.

With particular reference to FIG. 1, it can be seen that the anti-theft device of the invention comprises a magnetic anti-theft tag 1, its locking button 2 provided with a clamping point **2*a* and mounted on a sliding member 3, a support member 4 and a latching member 5**.

The tag 1 has on its upper face a first housing **1*a* at the opposite end from the locking end of the tag, a median housing 1*b* intended to receive the support member 4 and an end shoulder 1*c* with a hole 1*d* intended to receive the clamping point 2*a***.

The sliding member 3 has two angled parts or guide flanges 3*a*, an upper base 3*b* centrally cut so as to accommodate a flexible clip 3*c* at the free end of which is mounted a locking button 2 of the tag 1. This clip 3*c* has an axial rectangular port 3*d*. The upper base 3*b* of the sliding member 3 is extended by a second mobile clip 3*e* with an axial oblong port 3*f*, a clip forming a back stop 3*g* being provided at the extreme end of this flexible clip 3*e*.

The support member 4 is in the shape of a U-bar whose flanges 4*a* are intended to rest against the bottom of the housing 1*b* of the tag. This member 4 has a transversal oblong port 4*b* of the same configuration as the oblong port 3*f* in the clip 3*e* of sliding member 3, these ports being superimposed when the anti-theft device is assembled. In the upper base of the support member 4 is also a boss transversally aligned with the oblong port 4*b*, this boss preferably being in the form of a semi-cylinder 4*c*.

Figure 2:
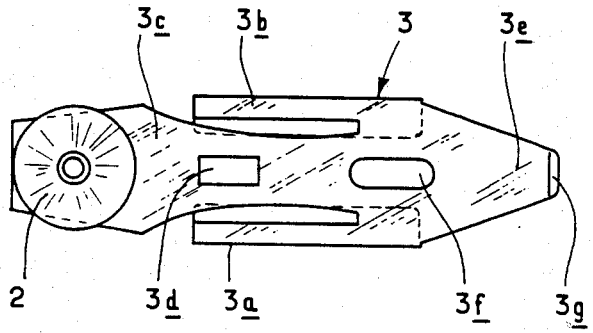
FIG. 2 is the support member viewed from above.
Figure 3:
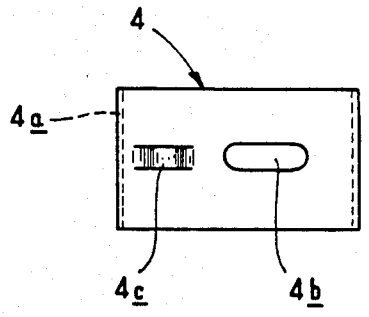
FIG. 3 is the sliding member viewed from above.

The latching member has the form of a split ring 5 from which angled clips 5*a*, 5*b* project. FIGS. 2 and 3 show in particular the sliding member 3 and the support member 4 viewed from above.

Figure 4:
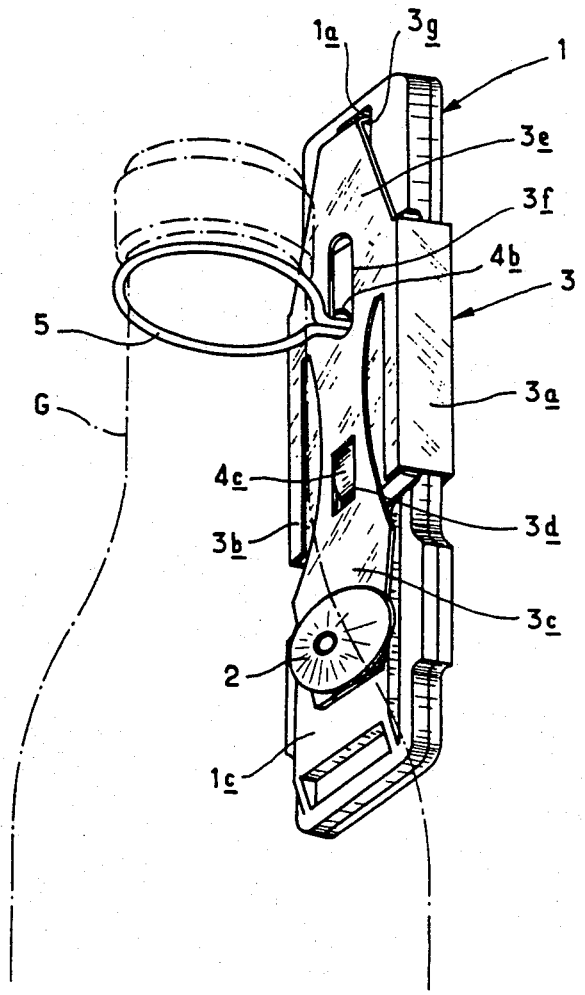
FIG. 4 is a perspective view of the anti-theft device of the invention mounted in locked position on a bottle.

With particular reference to FIG. 4, a description will now be given of the attachment of the anti-theft device of the invention, which is especially suitable for a recipient with a neck, to a bottle.

The latching member 5 is especially adapted to fit closely the shape of the neck G of the bottle below the upper enlarged part of the latter shown by the dashed lines in FIG. 4. The latching member 5 must in fact fit the shape of the neck as closely as possible at the narrowest point of the neck.

The support member 4 fits in its housing 1b in the magnetic tag 1, so that the flanges 4*a* abut the transverse walls of housing 1*b*. Sliding member 3 is then displaced so that port 3*f* superimposes port 4*b* of support member 4, member 3 abutting boss 4*c*. The angled clips 5*a*, 5*b*, of latching member 5 are then introduced by the said ports until the ends of the clips 5*a*, 5*b* open out under member 4*a*, after which latching member 5 is rotated approximately 90° and sliding member 3 is moved so as to trap clips 5*a*, 5*b* of ring 5 in ports 3*f*, 4*b* as a result of translatory motion imparted to sliding member 3 with respect to member 4, and so as to position point 2*a* of locking button 2 opposite its housing 1*d* in shoulder 1*c* of magnetic tab 1, the back stop 3*g* then being supported in housing 1*a*. Then the device is locked by pressure on button 2, thus trapping latching member 5, which latches the anti-theft device to the bottle to be protected until removed by releasing button 2 with the help of a suitable tool. Once button 2 is released, it is enough to push tongue 2*a* upwards in order to release it from boss 4*c*, and also to push tongue 3*e* upwards so as to release boss 3*g* from its support housing 1*a*. The client can then leave with his/her bottle having duly paid for it at the till.

In the form of the embodiment above, the latching member, support member and the sliding member are of materials of mechanical strength suitable for the purpose. Materials of the following types, could, for example, be used: plastic, iron, steel and various other alloys.

Figure 5:
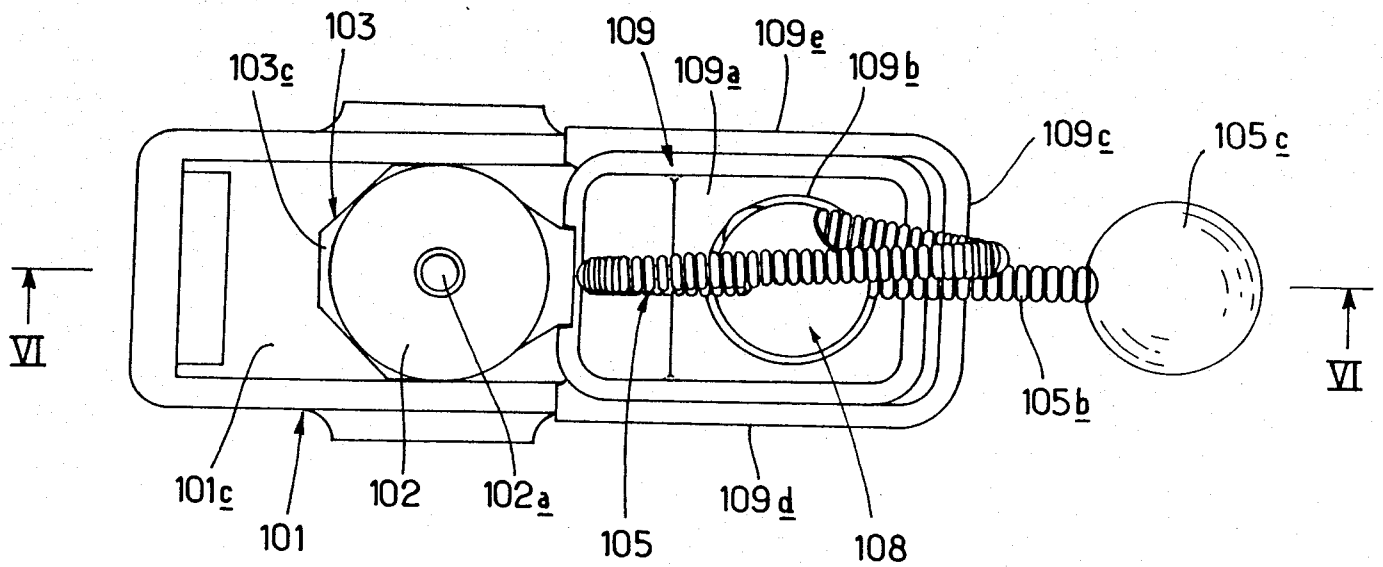
FIG. 5 is the variant of the embodiment of the anti-theft device of the invention viewed from above.
Figure 6:
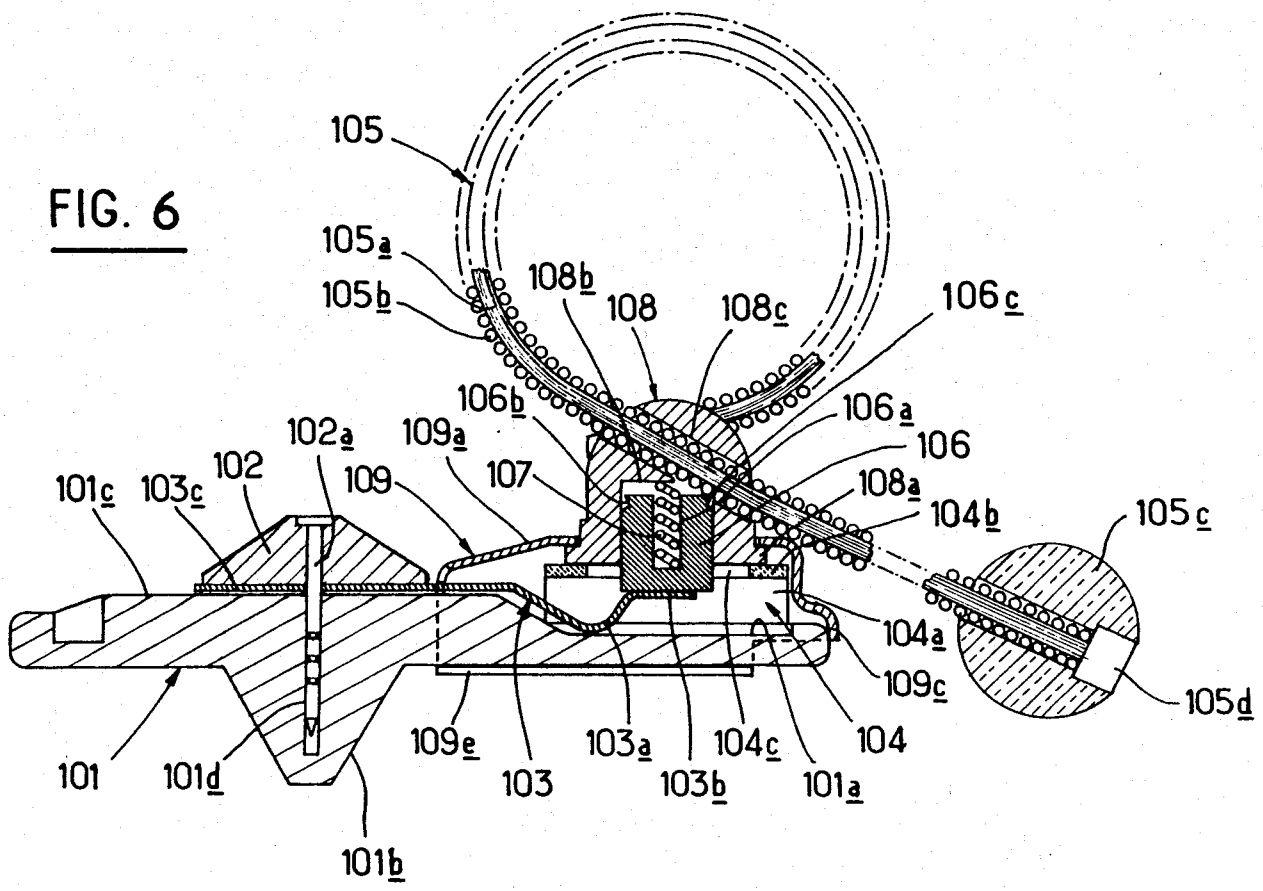
FIG. 6 is a view of a longitudinal axial section along line VI—VI of FIG. 5.

With special reference to FIG. 5 and 6, it can be seen that a variant of the anti-theft device comprises a magnetic anti-theft tag having a locking button 102 provided with a clamping point 102*a* and mounted on a flexible plate 103.

Member 101 has on its upper face a support area 101*a* intended to receive the support member 104 and an end shoulder 101*c* with a hole 101*d* intended for reception of the clamping point 102*a*. The flexible plate 103 has a boss 103*a* pressing against zone 101*a* and is extended by a shoulder 103*b* abutting against the head of a hollow piston 106 inside body 106*a* from which is fitted a spring 107, which is mounted sliding in the cavity 108*b* of an insert 108 joined to member 101 by means of a holding part 109. Plate 103 is provided at its end with a flexible clip 103*c* at the free end of which is mounted the locking button 102 of member 101. Piston 106 has an upper peripheral groove defining with the corresponding edge a sharpened rim 106*c*.

The holding part 109 is fixed to member 101 and joins the insert 108 and the support member 104 to the said member 101. For this purpose part 109 has a peripheral flange 109*b* which is supported by a peripheral shoulder 108*a* of the support part 108, which is itself supported on member 104, as well as upper 109*a*, lateral 109*c*, 109*d* and lower 109*e* holding zones on member 101.

The latching device is in the form of a collar 5 fixed at one end to part 108 and whose other end is connected to a ball or pull knob 105*c* by means of a fixing body 105*d*. The collar 105 comprises a core 105*a* enclosed by a threaded structure 105*b*. Part 108 is pierced by an oblique transversal port 108*c* which communicates with the cavity 108*b* of the said part 108 and is intended to receive the latching member so as to form an adjustable loop.

Collar 105 is especially adapted to fit closely the shape of the neck of a bottle or container below the upper enlarged part of the said neck. The collar 105, because of its design in the form of a loop, can be fitted as closely as possible around the narrowest part of the neck. After positioning of collar 105, the device is locked by pressure on button 102, the elastic reaction at the shoulder 103*b*, by means of boss 103*a*, acting on piston 106 against the action of spring 107, thus allowing the sharpened structure 106*c* to lock the collar 105 by insertion between two adjacent turns of the threaded structure 105*b*, which means that the collar 105 which latches the anti-theft device to the bottle to be protected is trapped until sale of the bottle, in which case button 102 is released with the help of a suitable tool. The client can then leave with his/her container or bottle having duly paid for it at the till.

In this variant of the embodiment of the anti-theft device according to the present invention, the components can be of various materials provided that they have mechanical strength properties suitable for the purpose. Various types of material can be used, for example: plastic, iron, steel and various other alloys.

It is clear that the invention is in no way limited to the form of the embodiment described above, adapted in particular to theft prevention for containers with necks, but that it covers all modifications and variants of the same basic principle.

In this way, the collar 5 may have any shape provided that it closely fits the appropriate zone of the anchoring structure. Similarly, while the support structure has been presented in the form of a support member 4, it could equally be joined to tag 1, for example by molding with the latter. Furthermore, button 2 and its locking nail 2*a* may also be manufactured with sliding member 3.

Similarly, while the support structure has been presented in the form of a plate 104, it could equally be joined to plate 101, for example by molding with the latter. Furthermore, button 102 and its locking nail 102*a* may also be manufactured with the tongue 103.

Thus, according to the present invention, a solution is provided to the problem of theft protection for items that do not allow anchoring of the usual magnetic tags, but which have an anchoring structure suitable for receiving the anti-theft device of the present invention.

What is claimed is:

1. An anti-theft device for articles with at least one anchoring structure, comprising an anti-theft magnetic tag having means for connection to said anchoring structure, wherein said means for connection to said anchoring structure comprises:

clamping means comprising a sliding member which fits closely to that of the magnetic tag, said sliding member having on its upper surface at one end of said sliding member a flexible clip cooperating with a locking device of the tag and at the other end of said sliding member a second flexible clip with abutment means at its free end, said second clip presenting in a longitudinal direction an oblong port intended to superimpose, before locking of the device, a port of corresponding shape provided in an underlying support member which is joined to the body of the tag and latching means for latching the clamping means and magnetic tag onto the anchoring structure of the article.

2. A device according to claim 1, in which said support member is a plate in the shape of a U-bar the flanges of which abut the upper face of the magnetic tag by entering a housing of corresponding shape in the said magnetic tag.

3. An anti-theft device according to claim 2, in which said plate presents an upper boss axially aligned with the oblong port which fits, when the device is assembled, in an opening of corresponding shape provided in the upper face of the sliding member.

4. An anti-theft device according to claim 1, in which the latching means comprise an anchor presenting an opening and having two opposing anchoring clips intended to be introduced into oblong ports of the sliding member and of the support member.

5. An anti-theft device according to claim 4, in which the anchor is a split ring comprising two angled anchoring clips.

6. A anti-theft device according to claim 1, in which, in the locking position of the device, the clips are trapped by the ports following translatory movement imparted to the sliding member with respect to the tag.

7. An anti-theft device for articles having at least one anchoring structure comprising an anti-theft magnetic tag having means for connection to the anchoring structure, said means for connection comprising clamping means for cooperating with a locking device and latching means for latching the clamping means to said anchoring structure, said clamping means comprising a flexible tongue having a flexible clip cooperating with the locking device of the plate and at the other end a second flexible clip, the tongue presenting between its free ends an internal boss abutting an underlying support member, wherein said second clip engages the locking means when in a locked position, said locking means having elastic means housed in a part supporting the latching means, said part itself being supported by said underlying support member which is joined to the body of the tag.

8. A device according to claim 7, in which said support member is a tag comprising a centrally arranged housing for reception of the flexible tongue.

9. An anti-theft device according to claim 7, in which said locking means comprise a piston against the head of which is supported the second clip of the flexible plate and which comprises at its upper end a peripheral groove delimiting with the corresponding edge a sharpened structure.

10. An anti-theft device according to claim 7, in which said elastic means comprise a spring housed inside the cavity of the piston, which is supported by its free end against the bottom of the cavity of the support part.

11. An anti-theft device according to claim 7, in which said latching means comprise an adjustable collar one end of which is fixed to the support part while the other end is provided with a pull knob.

12. An anti-theft device according to claim 11, in which said collar comprises a core provided with an outer threaded structure which thus defines a certain number of adjacent turns between which the upper sharpened structure of the piston fits when the device is in the locked position.

* * * * *